US005371979A

United States Patent [19]

Kwiatkowski et al.

[11] Patent Number: 5,371,979

[45] Date of Patent: Dec. 13, 1994

[54] SNOW STOP

[75] Inventors: Janusz Kwiatkowski, Arlington; Michael J. Mullane, Hudson, both of Mass.

[73] Assignee: M. J. Mullane Co., Hudson, Mass.

[21] Appl. No.: 154,956

[22] Filed: Nov. 19, 1993

[51] Int. Cl.[5] ..... E04D 13/00

[52] U.S. Cl. ..... 52/24; 52/26

[58] Field of Search ..... 52/24–26; 248/237

[56] References Cited

U.S. PATENT DOCUMENTS

| | | | |
|---|---|---|---|
| D. 30,788 | 5/1899 | Clark | D8/499 |
| 511,295 | 12/1893 | Esselen | 52/24 |
| 625,144 | 5/1899 | Clark | 52/24 |
| 654,438 | 7/1900 | Clark | 52/24 |
| 702,923 | 6/1902 | Clark | 52/24 |
| 1,222,953 | 4/1917 | Histand | 52/24 |
| 1,475,931 | 12/1923 | Campbell | 52/24 |
| 1,530,233 | 3/1925 | Campbell | 52/24 |
| 1,647,345 | 11/1927 | Douglas | 52/24 |
| 3,296,750 | 1/1967 | Zaleski | 52/24 |
| 3,583,133 | 6/1971 | Winski | 52/173 |
| 4,141,182 | 2/1979 | McMullen | 52/24 |

OTHER PUBLICATIONS

*Metal Construction News*, SNOWJAX advertisement (circa Jan., 1993).

Buyline Cast in Bronze Snow Guards trade literature, M. J. Mullane Co., Hudson, Mass. (Oct. 1, 1993).

*Primary Examiner*—Lanna Mai

*Attorney, Agent, or Firm*—Christopher John Rudy

[57] ABSTRACT

A new snow stop includes a base, a support projecting from the base, and a restraining member attached to or made integral with and part of the support, wherein the base has a support opening therein, and the support is formed from a suitable foldable stock and is attached to the base, the support having a leg which projects upwardly from the base and which thrusts through the support opening of the base, and the support having a foot which lies underneath the base and which extends outwardly of the support opening of the base. A method to make the snow stop includes providing an intermediate restraining member and support having an extended leg with enough suitable foldable stock to provide a foot, inserting the extended leg of the intermediate through a support opening of a base, and folding the suitable foldable stock inserted therethrough to provide a foot of the support. Use of the snow stop can include attachment to a roof. The new snow stop is significantly strong, particularly about its restraining, i.e., e.g., snow catching, member.

20 Claims, 4 Drawing Sheets

100

110
130
140
134
120
123
124
1
1
121
111
121
2
2
114

124
121
122
123
123
122
121
117
116
110
115
111
112
114
113

123
122
121
121
122
123
124

SNOW STOP

BACKGROUND

Various covers with projecting restrainers, to include snow stops, are known. Note, for example, the following U.S. patents:

H. Esselen, U.S. Pat. No. 511,295 (Dec. 19, 1893), Snow Guard.

E. Clark, Des. U.S. Pat. No. 30,788 (May 16, 1899), Snow Guard for Roofs.

E. Clark, U.S. Pat. No. 625,144 (May 16, 1899), Snow Guard.

E. Clark, U.S. Pat. No. 654,438 (Jul. 24, 1900), Snow Guard for Roofs.

S. Clark, U.S. Pat. No. 702,923 (Jun. 24, 1902), Roof Guard.

E. Histand, U.S. Pat. No. 1,222,953 (Apr. 17, 1917), Snow Guard.

A. Campbell, U.S. Pat. No. 1,475,931 (Dec. 4, 1923), Snow Guard.

A. Campbell, U.S. Pat. No. 1,530,233 (Mar. 17, 1925), Snow Guard.

C. Douglas, U.S. Pat. No. 1,647,345 (Nov. 1, 1927), Sheet Metal Snow Guard.

J. Zaleski, U.S. Pat. No. 3,296,750 (Jan. 10, 1967), Roof Snow Guard.

J. Winski, U.S. Pat. No. 3,583,113 (Jun. 8, 1971), Sheet Construction Material with Baffelike Members at Joints.

J. McMullen, U.S. Pat. No. 4,141,182 (Feb. 27, 1979), Corrosion Proof Snow Guard.

A snow guard asserted as being covered by the McMullen patent is offered for sale by Snowjax, Inc. See e.g., SNOJAX advertisement, *Metal Construction News* (circa January, 1993).

In addition, the M. J. Mullane Co., Hudson, Mass., markets a number of Snow Guard devices. Note, Buyline Cast in Bronze Snow Guards trade literature (Oct. 1, 1993) Models #10, #10-LC and #20.

A problem in the art is that of failure of some known snow stops, to particularly include from among those which projecting restrainer is composed of or is supported by sheet metal. This failure can occur for various reasons, to include not only that snow stops are sometimes installed in an amount insufficient to accommodate the weight of snow for a given roof area but also that the snow stops may be inherently too weak to withstand a certain threshold force applied to its projecting restrainer.

Another problem occasionally encountered in the art is that of bowing, caused in use of an elongated base, for example, one about 16 inches or so of bar stock, such as of brass or other metal, which is positioned below a full slate and fastened on the end distal to the snow catcher. Often, the fastened brass base bows and causes breaking of the slate under which it lies, particularly under the stress of accumulated snow.

It would be desirable to ameliorate or overcome such problems in the art. As well, it would be desirable to provide a new snow stop to the art, and ameliorate or overcome other problems in it.

SUMMARY

The present invention provides a new snow stop comprising a base, a support projecting from the base, and a restraining member attached to or made integral with and part of the support, wherein the base has a support opening therein, and the support is formed from a suitable foldable stock and is attached to the base, the support having a leg which projects upwardly from the base and which thrusts through the support opening of the base, and the support having a foot which lies underneath the base and which extends outwardly of the support opening of the base. A method to make the snow stop comprises providing an intermediate restraining member and support having an extended leg with enough suitable foldable stock to provide a foot, inserting the extended leg of the intermediate restraining member and support through a support opening of a base, and folding the suitable foldable stock inserted therethrough to provide a foot of the support. Use of the snow stop can comprise attachment to a roof.

The invention is useful in restraining snow, etc., on roofs.

The snow stop provided hereby is most significantly stronger than known snow stop devices, in particular, about its support. Comparable snow stop devices fail with much less force on their restraining members than do snow stops of the invention. Thus, snow stops hereof can withstand about 1½ times, nearly twice, and even more than twice, the force applied to their restraining members before failure than snow guards as of the aforementioned Campbell and Zaleski patents, made of generally comparable sheet metal parts. Thus in the art, a significant problem is solved or ameliorated, and a long standing lack and need is fulfilled. Neither, in general, does, or need, the snow stop hereof bow.

DRAWINGS

The drawings form part of the specification hereof. In the drawings, in general, like numerals refer to like features.

FURTHER ILLUSTRATIVE DETAIL

Figure 1:
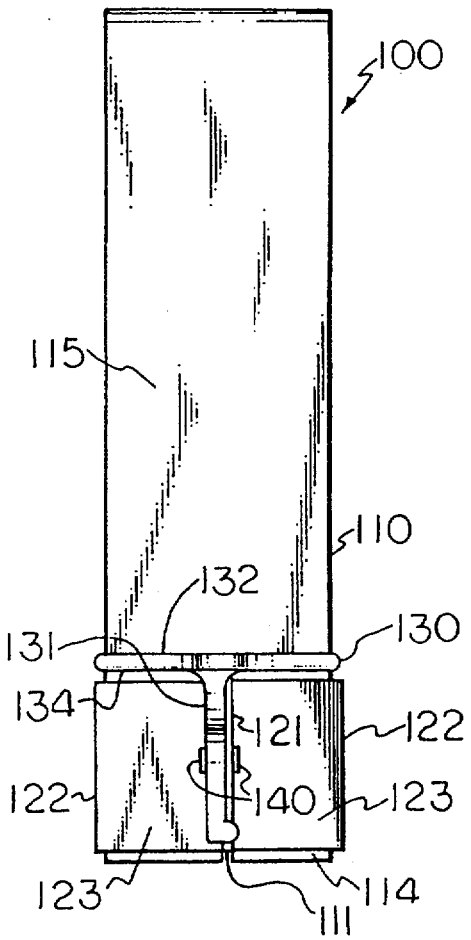
FIG. 1 is a top view of a snow stop of the invention.
Figure 2:
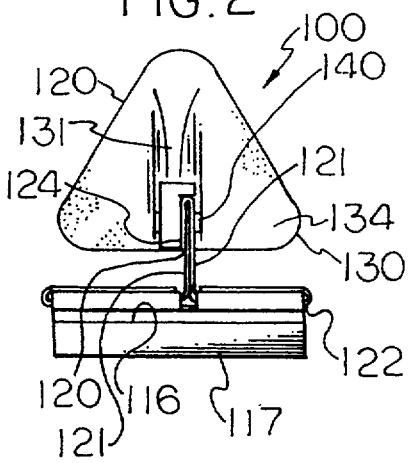
FIG. 2 is a rear view of the snow stop of FIG. 1.
Figure 4:
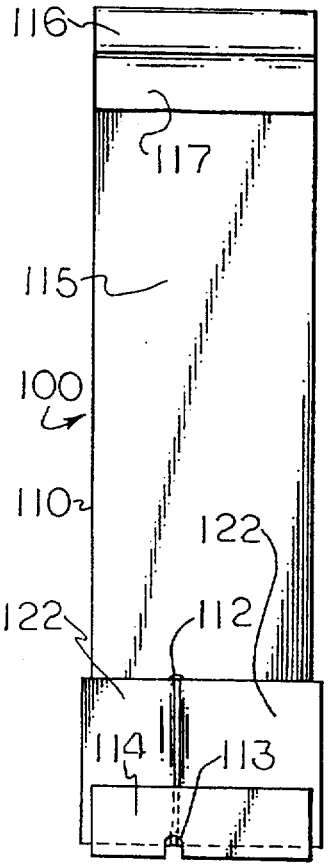
FIG. 4 is a bottom view of the snow stop of FIG. 1.
Figure 3:
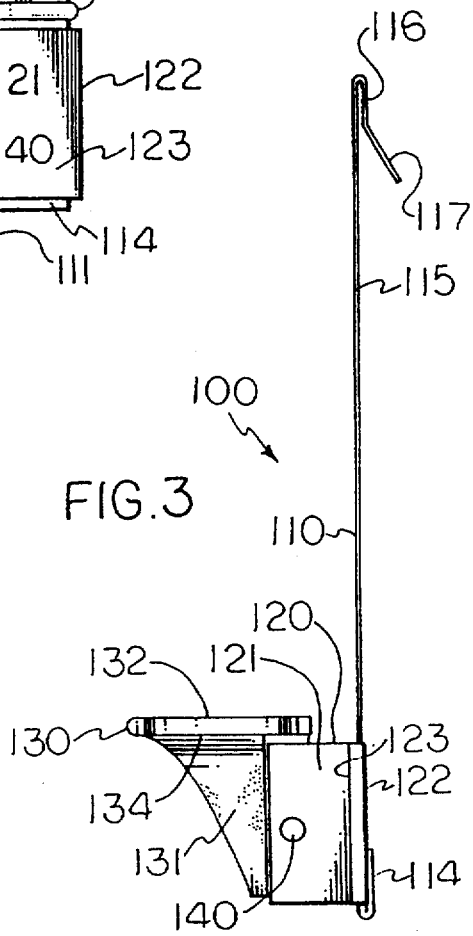
FIG. 3 is a side view of the snow stop of FIG. 1.

The cited Background art is incorporated herein by reference.

The invention is further illustrated hereby with reference to the drawings hereof. Accordingly, note the following:

In general, snow stop 100 has base 110, support 120 projecting from the base, and a restraining member 130 attached to or made integral with and part of the support. These may be of any suitable shape. The base has a support opening 111, in general, of any suitable shape. At least the support is formed from suitable foldable stock, which may include that which is of suitable woven inorganic or organic cloth, to include those such as of glass or metal fiber, cotton, nylon, polyester, polyolefin, and so forth and the like, that may or may not be impregnable with resins such as epoxies and So forth and the like, suitable plastics that may or may not be reinforced with fibers and/or mats, suitable bar stock or sheet metal, to include such as of or containing aluminum, copper, lead-coated copper, steel, stainless steel, nickel-coated steels, lead-coated steel, tin-coated steel, terne, lead and/or tin-coated stainless steel, zinc-coated steels, or any suitable other bar stock or sheet metal, coated or uncoated, but especially of a sheet metal of stainless steel or lead plus tin coated stainless steel, i.e., so-called terne-coated stainless (TCS), copper or lead-coated copper, in strip form, and is attached to the base. For example, the sheet metal strip may be 20-ounce cold rolled copper, which may be uncoated or, say, lead-coated, or the sheet metal strip may be 26-gauge stainless steel. A 24- or 32-ounce cold rolled copper sheet, coated with lead or not, or, say, a 24- or 28-gauge stainless steel sheet, and so forth and the like may be advantageously employed. The support has leg 121 which projects upwardly from the base and which thrusts through the support opening of the base. The support also has foot 122 which lies underneath the base and which extends outwardly of the edge (boundary) of the support opening of the base. The base can be made of any suitable material to include materials such as of wood, plastic to include polymeric acrylates, carbonates, urethanes, cast or sheet metal, and so forth and the like, but it is preferably of sheet metal, typically of the same type of sheet metal of which the support is made. The restraining member generally functions as a snow catcher and can be made of any suitable material to include materials such as wood, plastic to include as aforesaid, cast, bar stock, or sheet metal, and so forth and the like, but it is preferably either of a cast metal such as bronze, aluminum, iron, and so forth and the like, especially bronze or lead-coated bronze, or of sheet metal, especially of the same type of sheet metal of which the support is made, to particularly include of the very same sheet itself of which the support is made.

Preferably further, base 110 is suitably elongated. The base may have support opening 111 which longitudinally extends along a lengthwise-directed axis of the elongated base to accommodate the support, which is generally parallel-sided, and which may have semi-circular front 112 and/or rear 113 boundary ends. The base 110 may have multiple support openings, i.e., two parallel slits may be provided as the support opening. In each of these slits, a leg may be inserted for the support member. The semi-circular end can be a notable amount more strong than, say, a square-ended support opening which may be employed herein, for example, being about from 5 to 10 percent more strong than the square-ended, particularly as the front opening. The support opening may be placed off or on center to ultimately accommodate a particular design of restraining member such as, for example, a cast snow catcher of the snow guard for roofs as of the aforementioned Clark design patent as depicted within FIGS. 1–5 or a folded one-piece support and restraining member as of a snow stop as depicted in FIGS. 8–12. The base may have tail 114 at an exposable end folded under over foot 122, may be elongated with central part 115, and may have hook 116 and flange 117, at a hidable end, distal to the exposable end, to attach to slate, wood, or other shingles or shakes as is known in the art. The hook or flange may be looped 118 to touch the underside of the base; its touching end may be riveted 119 or otherwise fastened thereto, and the base may be thickened, to include by provision of a plurality of, for example, two, superimposed strips. See, FIG. 13. Note, the aforementioned Zaleski patent. Holes and/or mounting spurs as found in the aforementioned Histand patent may be provided in the base, say, about the hidable end. As an alternative, the base may be flat and/or without holes. Support 120, in addition to its foot 122, can have toe 123 folded over onto the base. Base tail 114 may be folded up over the toe in some snow stops, which could entail that the support opening be an open slot without a rear boundary. See, FIG. 6. Stiffening member 124 may be present with the support. See e.g., FIGS. 2 and 5 and 6 and 7. Restraining member 130 may have rear support fixture 131, face 132, ears 133 and back 134. Attachment of the support to the restraining member may be by rivet 140, or by any other suitable means such as welding, brazing, soldering, gluing, screwing, nailing, stapling, and so forth and the like.

Snow stops hereof may have a high degree of local or overall symmetry, notably about its support, which can play a part in improving resistance to failure under force on the restraining members. As well, the base, support and restraining member may be generally orthogonal to another. Additionally, strength is enhanced by placement of a foot of the support under the base. Regarding the great strength of snow stops hereof, in particular as provided by their unique support system, the following is in general tabulated, wherein force perpendicular to the restraining member is applied, with the base fixed to a test stand and force gauge in a manner to prevent bowing in test performance:

| Reference | Sheet Metal Material | Force at Failure |
|---|---|---|
| FIGS. 1–4, 13 | 20-oz. Copper | 500.0 Pounds |
| FIGS. 1–5* | 20-oz. Lead-coated Copper | 500.0 Pounds |
| FIGS. 1–5* | 20-oz. Copper | 500.0 Pounds |
| FIGS. 8–12 | 26-ga. Stainless Steel | 362.5 Pounds |
| FIGS. 8–12 | 20-oz. Copper | 370.0 Pounds |
| FIGS. 8–12 | 20-oz. Lead-coated Copper | 434.0 Pounds. |

*Designates models without hook, i.e., having flat base.

Dimensions of snow stops hereof may vary. A snow stop of the invention may have, for example, an overall length of about from 4 to 8 inches (ca. 10.2 to 20.3 cm) or so, say, about 6 inches (ca. 15.2 cm) or so, which can be determined by adaptation to a particular type of roof, shake, shingle or slate for which the snow stop is to be installed, an overall width of about from 1 to 3 inches (ca. 2.5 to 7.6 cm) or so, say, about $1\frac{1}{2}$ or $1\frac{3}{4}$ inches (ca. 3.8 or 4.4 cm) or so, and an overall height of the restraining member top from base of about from 1 to 4 inches (ca. 2.5 to 10.2 cm) or so, say, about $1\frac{3}{4}$ or $1\frac{1}{4}$ inches (ca. 4.4 or 5.7 cm) or so. The distance of the bottom of the restraining member from the base can be determined by adaptation to a particular type of roof, shake, shingle or slate for which the snow stop is to be installed. A distance of the bottom member from the base may be, for example, about from 1/16 to 1 inch (ca. 0.16 to 2.5 cm) or so, say, about from $\frac{1}{8}$ to $\frac{1}{2}$ of an inch (ca. 0.32 to 1.3 cm) or so. Actual dimensions of particular snow stops hereof may vary widely from these specified dimensions.

Figure 6:
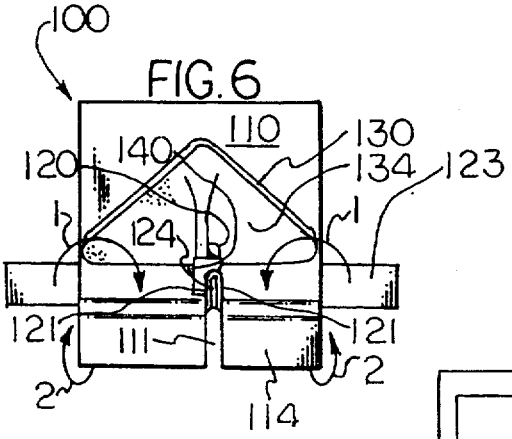
FIG. 6 is a rear perspective view of another snow stop embodiment hereof, partially assembled.
Figure 5:
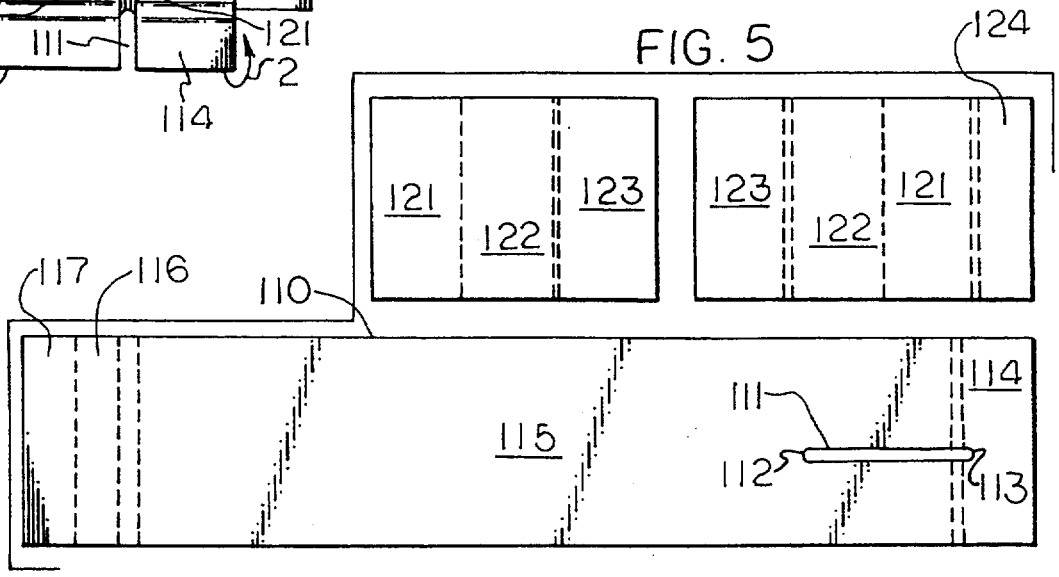
FIG. 5 is a plan view of the strips of foldable stock from which the base and support of the snow stop of FIG. 1 is made.
Figure 7:
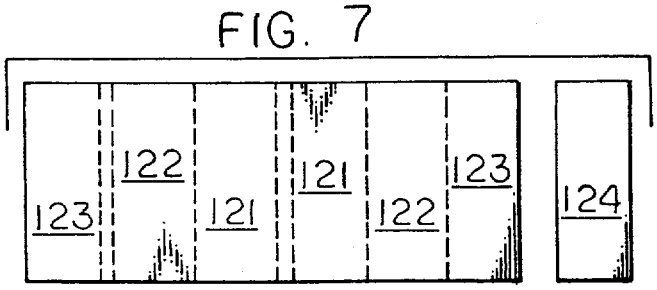
FIG. 7 is a plan view of the strips of foldable stock from which the support of the snow stop of FIG. 6 is made.
Figure 8:
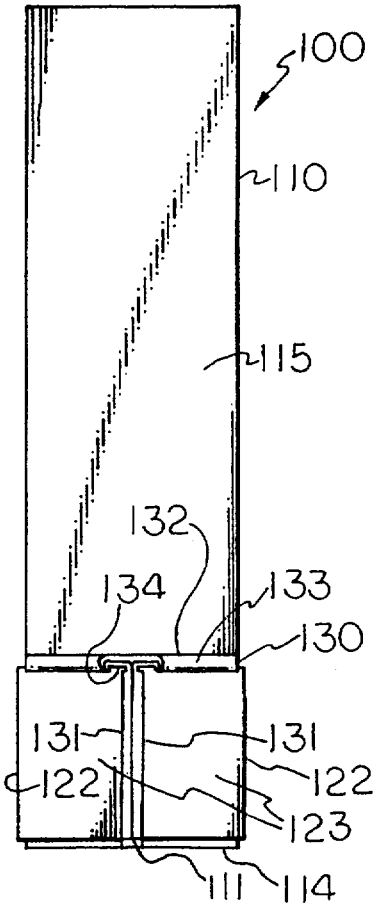
FIG. 8 is a top view of another snow stop embodiment hereof, which has an integral, one-piece, support and restraining member.
Figure 9:
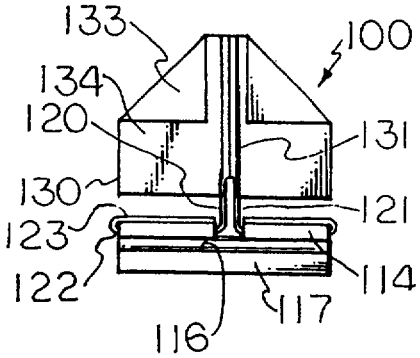
FIG. 9 is a rear view of the snow stop of FIG. 8.
Figure 10:
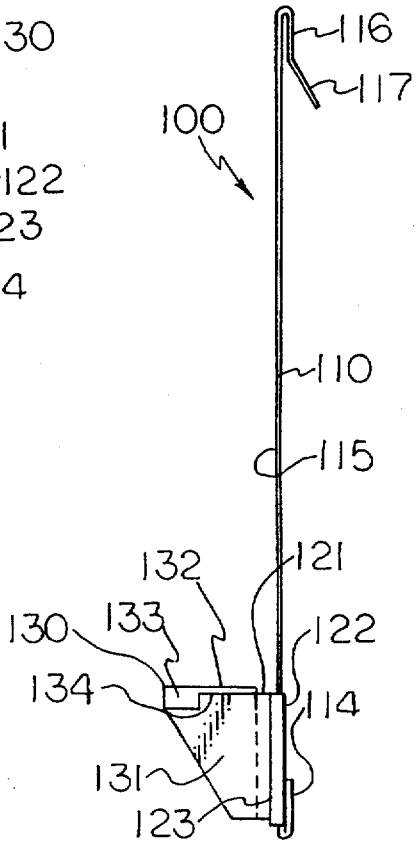
FIG. 10 is a side view of the snow stop of FIG. 8.
Figure 11:
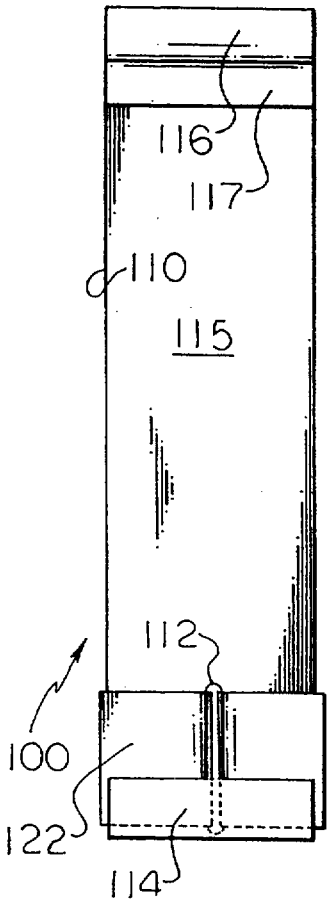
FIG. 11 is a bottom view of the snow stop of FIG. 8.
Figure 12:
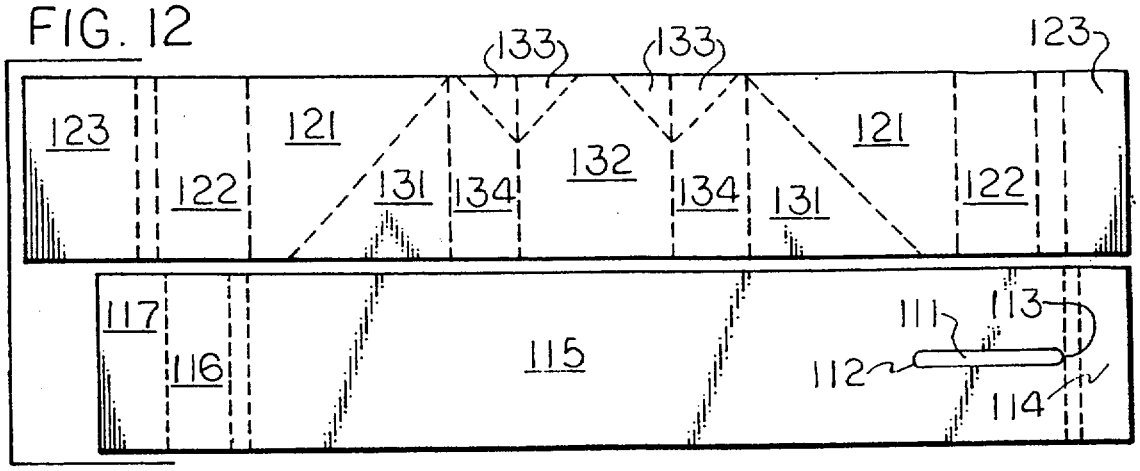
FIG. 12 is a plan view of the strips of foldable stock from which the snow stop of FIG. 8 is made.
Figure 13:
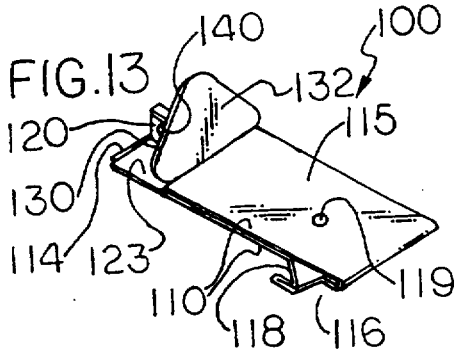
FIG. 13 is a perspective view of a snow stop hereof as well.

The snow stop hereof may be made by any suitable method. The snow stop may be made, for instance, by providing an intermediate restraining member and support having an extended leg with enough suitable foldable stock to provide a foot, inserting the extended leg of the intermediate restraining member and support through a support opening of a base, and folding the stock inserted therethrough to provide a foot of the support, which rests under material of the base. Further steps may be carried out such as with folding appropriate portions of a stock to provide the tail, hook and/or flange of the base, or looping the hook, if it is foldable, and/or folding appropriate portions of the stock to provide the toe and/or stiffening member of the support, and/or adding separate stiffening member(s), and/or folding appropriate portions of a stock of a foldable restraining member to provide the ears, as may be desired. For example, in making the folded one-piece support and restraining member of a snow stop as of FIGS. 8–12, a lead-coated 20-ounce cold-rolled copper sheet may be provided, cut and marked as set forth in FIG. 12, first folded along the dotted lines to provide face 132 in square-like form, then folded back to provide back parts 134 for the face, with folding up to provide incipient features 131, 121, 122 and 123 in registry, as a stem of a letter "T." Then, major diagonal folds, outwardly from the stem and preferably at about 45 degrees, are made so that features 122 and 123 are side by side. This incipient foot and toe portion is inserted into the support opening of the base, and the feet and toes are provided by securely folding the foldable stock under, around and on top of the base. A base with a foldable tail 114 may then be folded under the foot, clamping it securely in place. See, FIGS. 2–4, 9–11 and 13. Compare, FIG. 6, to include its upwardly directed arrows 1 and 2, which indicate first (toe) and second (tail) foldings, respectively. In the folded one-piece support and restraining member of the snow stop of FIGS. 8–12, finally, folds can be made along minor diagonal folds to provide ears 133. In FIGS. 5, 6 and 12, the dotted lines generally indicate where folds are to be made in a foldable stock. Alternatively thereto, or in addition, a support and restraining member may be welded, brazed, soldered, glued, screwed, nailed, stapled, riveted, and so forth and the like, to the base, especially about the support foot and any toe.

Snow stops of the invention can be used by being attached to a roof for a building structure. Attachment may be by nailing, employing nails and/or using any spurs that are part of a base, stapling, screwing, gluing, soldering, brazing, welding, hooking as with a hook part attached to or integral with a base, as may be appropriate, and so forth and the like. With slate, shake and shingle roofs, the snow stop hereof is preferably placed between individual slates, shakes and shingle flaps. With metal roofs, soldering may be desired to attach metal-based snow stops hereof. Other methods may be employed. Actual attachment and spacing may be determined by architectural/engineering considerations, local code or custom, or other methods known or developed in the art.

Numerous further advantages attend the invention.

CONCLUSION

The present invention is thus provided. Numerous adaptations and modifications can be effected by those of skill in the art within the spirit of the invention, the asserted scope of which is particularly pointed out as follows:

We claim:

1. A snow stop comprising a base, a support projecting from the base, and a restraining member attached to the support, wherein the base has a support opening therein, and the support is formed from a suitable foldable stock and is attached to the base, the support having a leg supporting the restraining member, which leg has upper and lower portions, the leg projecting upwardly from under the base so as to thrust the upper portion of the leg through the support opening of the base to a position substantially above the base, the restraining member being attached directly to the upper portion of the leg, and the support also having a foot continuing on from the lower portion of the leg, which foot lies underneath the base and extends outwardly of the support opening of the base.

2. The snow stop of claim 1, wherein the support opening is a longitudinal slot; the support is generally orthogonal to the base, with the leg present in at least two generally parallel sections; two feet are generally present, and the restraining member is generally orthogonal to the support and to the base.

3. The snow stop of claim 2, wherein the foldable stock is a sheet metal; the base is made of a sheet metal; the support has a toe continuing from each foot, which wraps around on top of the base, and the base has a wrapped tail.

4. The snow stop of claim 3, wherein the restraining member is made of a cast metal.

5. The snow stop of claim 4, wherein the sheet metal is in the form of a metal selected from the group consisting of a copper, a lead-coated copper, a lead-coated steel, a tin-coated steel, a stainless steel, and a terne-coated stainless steel.

6. The snow stop of claim 5, wherein a stiffening member is present in conjunction with the support.

7. The snow stop of claim 6, wherein the sheet metal is in the form of a metal selected from the group consisting of copper and lead-coated copper.

8. The snow stop of claim 7, wherein the base contains plural layers of the sheet metal.

9. The snow stop of claim 2, wherein the foldable stock is a sheet metal.

10. A snow stop comprising a base, a support projection from the base, and a restraining member made integral with and part of the support, as one piece, wherein:

the base has a support opening therein, and the support is formed from a suitable foldable stock and is attached to the base, the support having a leg which projects upwardly from the base and which thrusts through the support opening of the base, and the support having a foot which lies underneath the base and which extends outwardly of the support opening of the base;

the support opening is a longitudinal slot, the support is generally orthogonal to the base, and the restraining member is generally orthogonal to the support and to the base;

two feet are generally present, and the one-piece support and restraining member is made of a foldable stock in strip form to provide a face of the restraining member in at least an initial square-like form, folded further to provide back parts of the face, folded further to provide internally positioned support stock stem members in general registry, folded further outwardly and downwardly from the stem members and at an angle of about 45 degrees to provide the leg, which is outside the stem members, and folded further to provide the feet and a toe continuing from each foot, which toes are folded under, around and on top of the base.

11. The snow stop of claim 10, wherein the base has a suitable foldable tail, which is folded down over the feet or up over the toes.

12. The snow stop of claim 11, wherein folds are made along diagonals in the face to provide ears which lie on the back of the face of the restraining member.

13. The snow stop of claim 12, wherein the foldable stock is a sheet metal, and the base is made of a sheet metal.

14. The snow stop of claim 13, wherein the sheet metal is in the form of a metal selected from the group consisting of a copper, a lead-coated copper, a lead-coated steel, a tin-coated steel, a stainless steel, and a terne-coated stainless steel.

15. The snow stop of claim 14, wherein the sheet metal is in the form of a metal selected from the group consisting of copper and lead-coated copper.

16. The snow stop of claim 15, wherein the sheet metal is a stainless steel or a terne-coated stainless.

17. A modified building structure comprising a snow stop having a base, a support projecting from the base, and a restraining member attached to the support, wherein the base has a support opening therein, and the support is formed from a suitable foldable stock and is attached to the base, the support having a leg supporting the restraining member, which leg has upper and lower portions, the leg projecting upwardly from under the base so as to thrust the upper portion of the leg through the support opening of the base to a position substantially above the base, the restraining member being attached directly to the upper portion of the leg, and the support also having a foot continuing on from the lower portion of the leg, which foot lies underneath the base and extends outwardly of the support opening of the base, which snow stop is attached to a roof of a building structure.

18. The modified building structure of claim 17, wherein the restraining member of the snow stop is of cast metal.

19. The modified building structure of claim 17, wherein the support opening of the snow stop is a longitudinal slot; the support of the snow stop is generally orthogonal to the base, with the leg of the snow stop present in at least two generally parallel sections; two feet are generally present in the snow stop; the restraining member of the snow stop is generally orthogonal to the support of the snow stop and to the base of the snow stop, and the foldable stock of the snow stop is a sheet metal.

20. A modified building structure comprising a snow stop having a base, a support projecting from the base, and a restraining member made integral with and part of the support, as one piece, wherein:

the base has a support opening therein, and the support is formed from a suitable foldable stock and is attached to the base, the support having a leg which projects upwardly from the base and which thrusts through the support opening of the base, and the support having a foot which lies underneath the base and which extends outwardly of the support opening of the base;

the support opening is a longitudinal slot, the support is generally orthogonal to the base, and the restraining member is generally orthogonal to the support and to the base;

two feet are generally present, and the one-piece support and restraining member is made of a foldable stock in strip form to provide a face of the restraining member in at least an initial square-like form, folded further to provide back parts of the face, folded further to provide internally positioned support stock stem members in general registry, folded further outwardly and downwardly from the stem members and at an angle of about 45 degrees to provide the leg, which is outside the stem members, and folded further to provide the feet and and a toe continuing from each foot, which toes are folded under, around an on top of the base, which snow stop is attached to a roof of a building structure.

* * * * *